US006419443B2

(12) United States Patent
Takenoshita et al.

(10) Patent No.: US 6,419,443 B2
(45) **Date of Patent: *Jul. 16, 2002**

(54) GLASS PRODUCT MACHINING APPARATUS

(75) Inventors: Toshimasa Takenoshita; Hiroshi Saeki, both of Mihara; Kuniaki Wakusawa; Motofumi Kuroda, both of Hiroshima, all of (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,493

(22) Filed: Apr. 26, 1999

(30) Foreign Application Priority Data

Apr. 27, 1998 (JP) ..... 10-117082

(51) Int. Cl.[7] ..... B24B 49/00; B24B 41/00

(52) U.S. Cl. ..... 415/11; 451/41; 451/212; 451/343

(58) Field of Search ..... 451/11, 41, 56, 451/212, 213, 216, 226, 343

(56) References Cited

U.S. PATENT DOCUMENTS

| | | | | | |
|---|---|---|---|---|---|
| 3,693,297 | A | * | 9/1972 | Cann | 451/216 |
| 3,910,159 | A | | 10/1975 | Gladwin | |
| 4,172,338 | A | | 10/1979 | Kojo et al. | |
| 4,811,522 | A | * | 3/1989 | Gill, Jr. | 451/285 |
| 4,907,371 | A | | 3/1990 | Shoda et al. | |
| 4,928,435 | A | | 5/1990 | Masaki et al. | |
| 4,953,522 | A | * | 9/1990 | Vetter | 451/56 |
| 5,272,843 | A | * | 12/1993 | Maruyama et al. | 451/56 |
| 5,620,358 | A | * | 4/1997 | Furukawa et al. | 451/56 |
| 5,679,054 | A | * | 10/1997 | Chun et al. | 451/216 |
| 5,707,272 | A | * | 1/1998 | Hasimoto et al. | 451/41 |
| 5,718,619 | A | * | 2/1998 | Merrill et al. | 451/41 |
| 5,733,179 | A | * | 3/1998 | Bauer | 451/41 |
| 5,895,311 | A | * | 4/1999 | Shiotani et al. | 451/216 |
| 5,954,566 | A | * | 9/1999 | Bauer | 451/41 |

FOREIGN PATENT DOCUMENTS

| | | |
|---|---|---|
| JP | 09314450 | 12/1997 |

* cited by examiner

*Primary Examiner*—M. Rachuba
(74) *Attorney, Agent, or Firm*—John P. White; Cooper & Dunham LLP

(57) ABSTRACT

A glass product machining apparatus comprises a grindstone rotatable around an axis by means of a motor, moving table movable under the grindstone in the cross direction of the grindstone, frame for supporting the grindstone for up-and-down motion, lift, guides, supporting arms, pressure cylinder supported on the frame, and dressing machine for dressing or truing the grindstone. The pressure cylinder serves to apply a fixed elastic load to the grindstone as the grindstone shifts its position upward. A glass panel is located on the moving table. The panel moves together with the table. When the panel passes under the grindstone, an outer peripheral surface of the grindstone is brought into contact with the surface of the panel with a fixed force of pressure by the pressure cylinder. The grindstone relatively moves along the curved surface of the panel as it grinds the panel surface.

12 Claims, 7 Drawing Sheets

GLASS PRODUCT MACHINING APPARATUS

BACKGROUND OF THE INVENTION

The present invention relates to a glass product machining apparatus used to shape the surface of a glass product having a surface, such as a panel that constitutes the front portion of a Braun tube or cathode ray tube of a television set.

After a glass product having a surface, e.g., a glass panel that constitutes the front portion of a cathode ray tube of a television set, is press-molded, its surface is polished and finished into a smooth one. Conventionally, the panel surface is polished in a manner such that a polishing slurry is poured onto it as a polisher is slid thereon to correct its shape.

FIGS. 13 and 14 show the basic concept of the conventional polishing method. In these drawings, symbol P designates a panel that has a surface. The panel P is placed on a moving table 1. After the panel P is fixed to the table 1, a polisher 3 is brought into contact with the surface of the panel P under a fixed pressure F. Then, the moving table 1 is reciprocated in an axial direction T of the panel P, and a polishing slurry Q is poured into the gap between the polisher 3 and the panel P by means of a hose 4, whereupon the surface of the panel P is polished. In doing this, the whole panel surface can be polished by gradually moving the polisher 3 in a direction (indicated by arrow S in FIG. 13) perpendicular to the moving direction T of the moving table 1. In moving the polisher 3 in the direction S, the polisher 3 is inclined corresponding to the curvature of the surface of the panel P.

There are three types of polishers 3 for three different stages of polishing, rough polishing, medium-roughness polishing, and finish polishing. These polishers of different types may be prepared and changed with the progress of polishing. Alternatively, a machine is used exclusively for each polisher. In either case, a polishing slurry for each polishing stage is poured into a sliding zone between the polisher 3 and the panel P as the panel surface is polished.

In the conventional polishing system arranged in this manner, however, the surface of the glass product must be polished as the polishing slurry is poured. Correcting distortion of the product surface and polishing the surface take much time, so that the operating efficiency lowers inevitably.

BRIEF SUMMARY OF THE INVENTION

Accordingly, the object of the present invention is to provide a glass product machining apparatus capable of efficiently shaping the surface of a glass product in a short time.

According to the present invention, there is provided a glass product machining apparatus for machining and finishing a surface of a glass product, which comprises a rotatable grindstone, a moving table horizontally movable under the grindstone, supporting means for supporting the grindstone for up-and-down motion, and elastic load applying means for applying a fixed elastic load to the grindstone supported by the supporting means as the position of the grindstone is shifted upward. The glass product is placed on the moving table. As the glass product, along with the moving table, moves under the grindstone, the grindstone is brought into contact with the surface of the glass product with a fixed force of pressure by the elastic load applying means. In this state, the grindstone relatively moves along the surface of the glass product, thereby grinding the product surface.

According to the invention, moreover, there is provided another glass product machining apparatus, which comprises a rotatable grindstone, a moving table horizontally movable under the grindstone, supporting means for supporting the grindstone for up-and-down motion, and position control means for controlling the position of the grindstone supported by the supporting means. The glass product is placed on the moving table. As the glass product, along with the moving table, moves under the grindstone, the position control means controls the position of the grindstone that grinds the surface of the glass product.

In the glass product machining apparatus of the invention constructed in this manner, the glass product is caused to pass under the rotating grindstone, and the surface of the glass product is ground by means of the grindstone, whereupon the surface of the glass product is finished. Thus, according to the apparatus of the invention, a polishing slurry, which is essential to the conventional polishing system, is unnecessary, so that the machining time can be shortened by a large margin. Accordingly, the efficiency of operation for finishing the glass product is securely improved. Since the polishing slurry is not used, moreover, the cost of equipment, environmental conditions, etc. can be improved considerably.

Preferably, the apparatus according to the invention is provided with a dressing machine for dressing or truing the grindstone in case of loading and so on. With this arrangement, loading of the grindstone can be easily corrected by means of the dressing machine so that the grindstone can be reused.

Preferably, furthermore, the apparatus according to the invention is provided with inclination adjusting means for correspondingly inclining the grindstone or the glass product when the surface of the glass product on the moving table is inclined at an angle to the longitudinal axis of the grindstone in the width direction of the glass product, thereby adjusting the inclination of the grindstone or the glass product so that the grindstone is in contact with the product surface throughout its length. If the surface of the glass product on the moving table is inclined with respect to the longitudinal axis of the grindstone in the width direction thereof, with this arrangement, the inclination adjusting means can bring the grindstone into contact with the product surface throughout its length despite the inclination, so that the product surface can be ground uniformly.

In the glass product machining apparatus according to the invention, the axial length of the grindstone may be substantially equal to the width of the glass product, so that the whole surface of the glass product can be ground at a stroke when the glass product passes once under the grindstone. Alternatively, in the apparatus of the invention, the axial length of the grindstone may be shorter than the width of the glass product, so that the grindstone is moved in the width direction of the glass product with each of times the glass product is caused to pass under the grindstone as the whole surface of the glass product is ground.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Preferred embodiments of the present invention will now be described with reference to the accompanying drawings of FIGS. 1 to 12.

Figure 1:
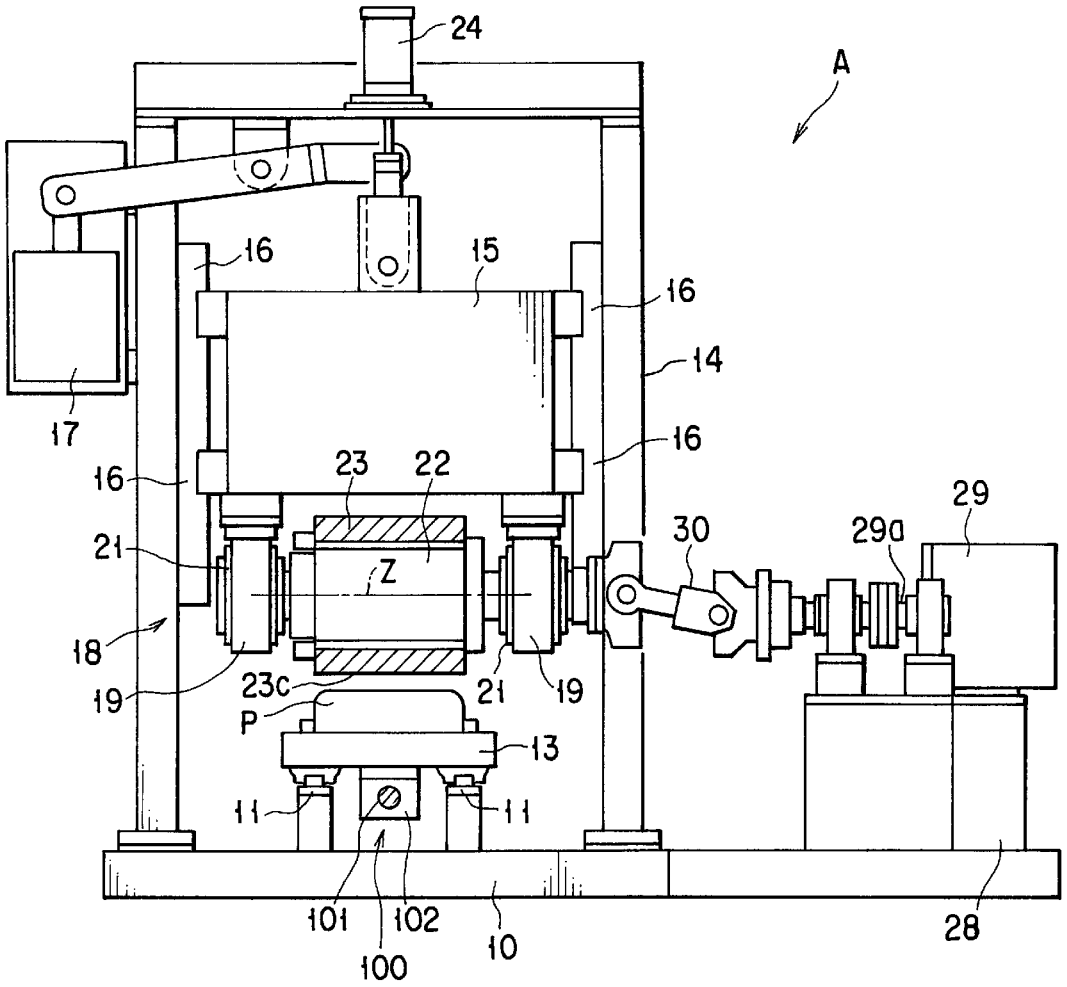
FIG. 1 is a front view, partially in section, showing a glass product machining apparatus according to a first embodiment of the present invention.
Figure 2:
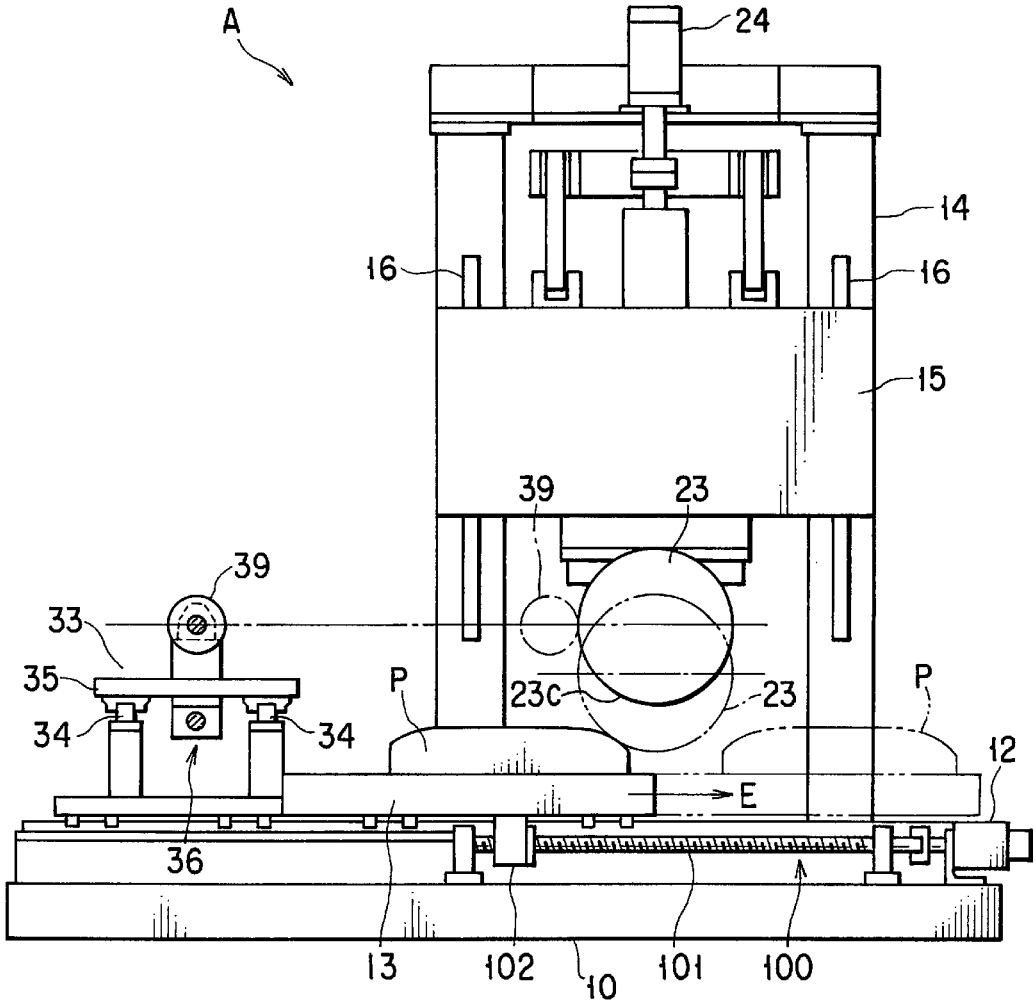
FIG. 2 is a side view of the glass product machining apparatus shown in FIG. 1.
Figure 3:
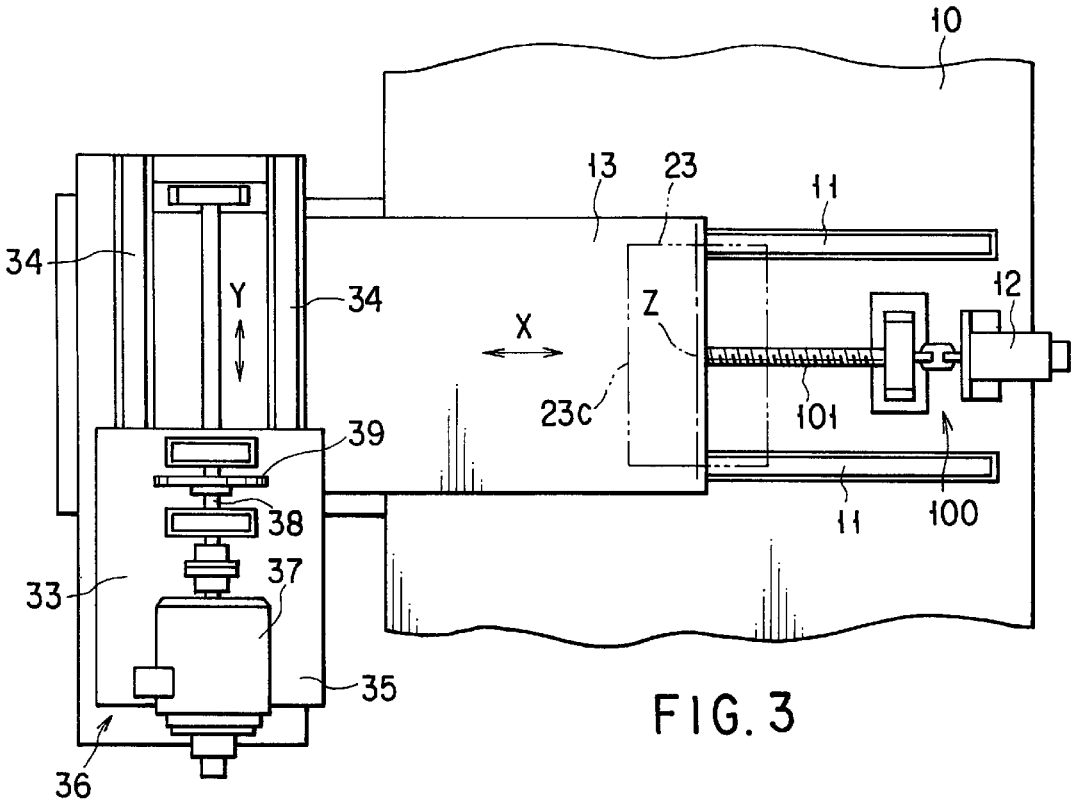
FIG. 3 is a plan view of a part of the glass product machining apparatus shown in FIG. 1.

FIGS. 1 to 6 show a first embodiment of the present invention. FIG. 1 is a front view of a machining apparatus A for machining the surface of a glass product (panel P) such as a cathode ray tube, and FIG. 2 is a side view of the apparatus A. The machining apparatus A comprises a base 10. As shown in FIG. 3, guide rails 11 are arranged above the base 10. A moving table 13 is located on the rails 11 so that it can reciprocate horizontally along the rails 11. The table 13 is moved in the longitudinal direction (direction indicated by arrow X in FIG. 3) along the guide rails 11 by means of a feed mechanism 100, which uses a motor 12 as its drive source. The feed mechanism 100 includes a feed screw 101, which is rotated by means of a motor 12 such as a servomotor, and a nut member 102 that mates with the screw 101. The nut member 102 provided on the table 13. When the feed screw 101 is rotated by the motor 12, in this case, the nut member 102 advances screwing corresponding to the rotating direction and speed of the screw 101, whereupon the table 13 moves in the direction indicated by arrow X.

A frame 14 is set up on the base 10. A lift 15 is attached to the frame 14. The lift 15 is supported for up-and-down motion on the frame 14 by means of LM (linear motion) guides 16 that extend in the vertical direction. The lift 15 can be accurately moved up and down with a small force in a manner such that its weight is balanced by means of a counterweight 17.

Figure 5:
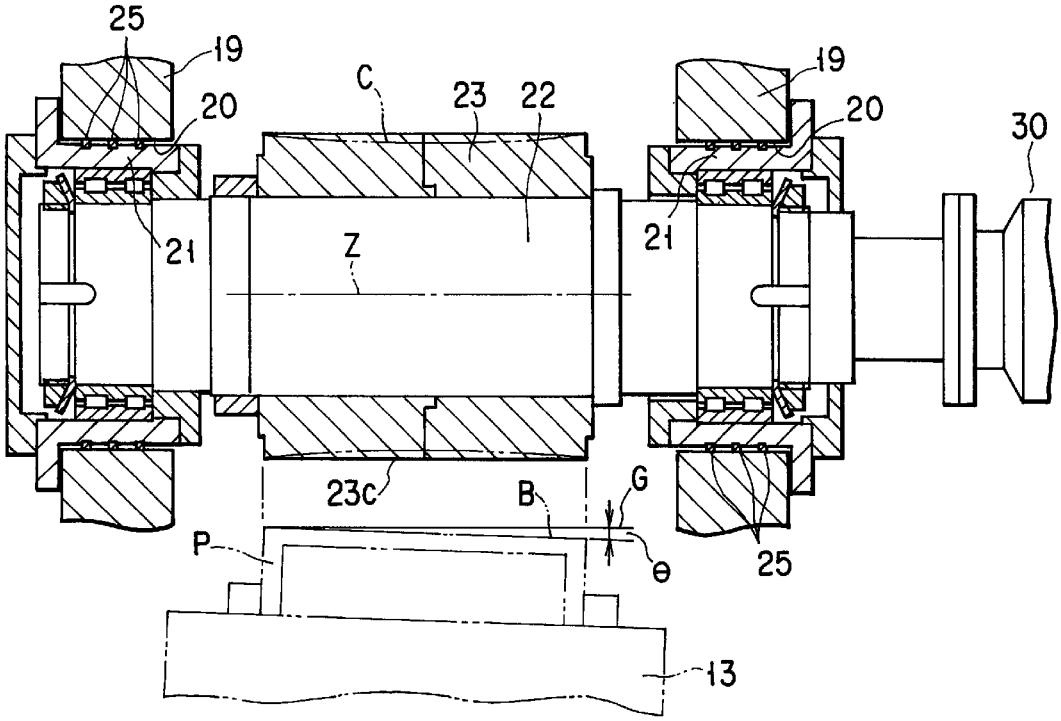
FIG. 5 is a sectional view of a grindstone supporting portion of the glass product machining apparatus shown in FIG. 1.

A pair of supporting arms 19, left and right, are opposed to each other at the lower part of the lift 15. As shown in FIG. 5, a fitting hole 20 is formed in each arm 19. A bearing 21 is set in each hole 20. A main spindle 22 is horizontally supported for rotation by means of the bearings 21. A cylindrical formed grindstone 23 is fixed to the outer periphery of the middle portion of the spindle 22. The grindstone 23 rotates integrally with the spindle 22. The grindstone 23 has an outer peripheral surface 23*a* that centers around the axis Z. The grindstone 23 may alternatively be hourglass-shaped, as indicated by two-dot chain line C in FIG. 5. The frame 14, lift 15, supporting arm 19, bearing 21, etc. constitute supporting means 18 for supporting the grindstone 23 for vertical movement and rotation around the axis Z.

A spring-type pressure cylinder 24 for use as elastic load applying means is provided on the upper part of the frame 14. It is used to apply a fixed elastic load to the vertically movable grindstone 23 as the grindstone 23 shifts its position upward. The cylinder 24 is designed to urge the grindstone 23 downward by means of the repulsive force of compressed gas charged therein or the elastic force of a spring, for example.

A plurality of elastic bodies 25 of rubber or the like for use as inclination adjusting means are interposed between the outer peripheral surface of each bearing 21 for supporting the main spindle 22 of the grindstone 23 and the inner peripheral surface of each corresponding fitting hole 20. The spindle 22 can incline at a narrow angle to the horizontal direction as the elastic bodies 25 are elastically deformed.

A grindstone driving motor 29 is mounted on a holder 28 beside the frame 14. An output shaft 29*a* of the motor 29 and the main spindle 22 are connected to each other by means of a universal joint 30. The joint 30 enables the grindstone 23 to shift its position in the vertical direction along the LM guides 16.

Figure 4:
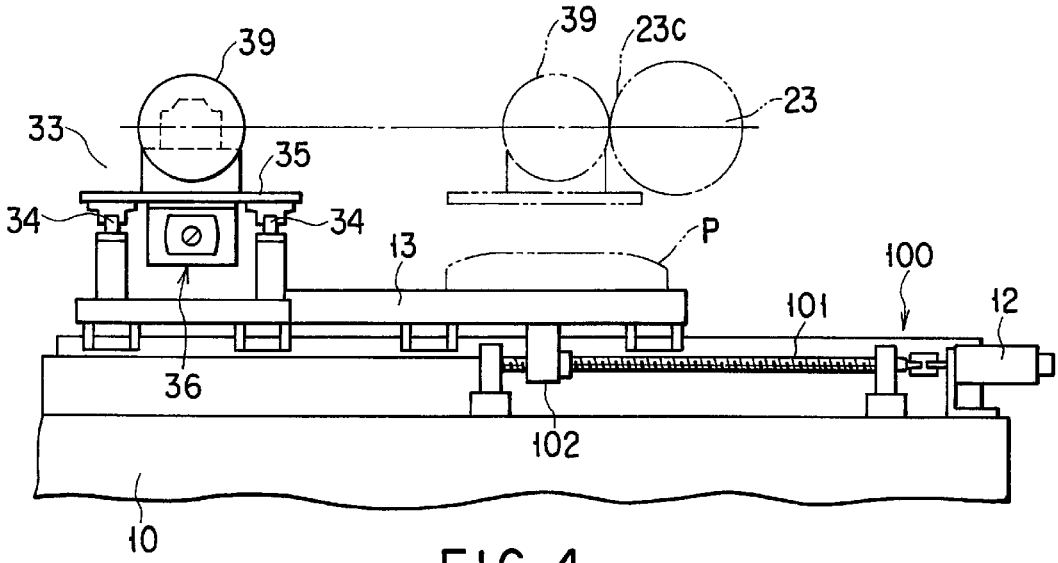
FIG. 4 is a side view of the part of the glass product machining apparatus shown in FIG. 1.

A dressing machine 33 is provided on one end portion of the moving table 13. As shown in FIGS. 3 and 4, the machine 33 has a holder 35 on the table 13. The holder 35 is supported on guide rails 34, which extend in a direction Y perpendicular to the moving direction X of the table 13. The holder 35 is driven to move in the direction Y along the rails 34 by means of a drive mechanism 36. A main spindle 38, which is rotated by means of a motor 37, is provided on the holder 35. A dresser 39 is mounted on the spindle 38. The spindle 38 that supports the dresser 39 extends parallel to and is located on the same height level as the main spindle 22 that supports the grindstone 23. The dresser 39, which is represented by a diamond dresser, for example, has functions to dress and true the working surface (outer peripheral surface 23*c*) of the grindstone 23 into an accurate shape.

Dressing is an operation to correct the shape of the working surface of the grindstone 23 in order to expose fresh sharp abrasive cutting edges on the working surface of the grindstone 23 when the working surface is loaded. Truing is an operation to rebalance the grindstone 23 or reshape its working surface into a nearly new state when the grindstone 23 is deformed due to uneven wear or from some other cause.

In FIGS. 1, 2, etc., symbol P designates a panel as an example of the glass product that constitutes the front portion of the cathode ray tube of the television set. As shown in FIG. 2, the surface of the panel P is an upwardly convex surface that is curved gently. After press molding, the curved surface of the panel P is shaped into a predetermined shape by means of the machining apparatus A according to the invention.

The following is a description of a process for forming the surface of the panel P by using the machining apparatus A according to the present embodiment. First, the panel A is fixed on the moving table 13 with its curved surface upward. Then, the grindstone 23 is rotated by means of the motor 29, and the moving table 13 is driven by means of the motor 12 so that the panel P on the table 13 is moved in the direction of arrow E in FIG. 2 toward the grindstone 23.

As the panel P is moved in this manner, it gets under the grindstone 23, whereupon the outer peripheral surface 23*c* of the rotating grindstone 23 comes into contact with the surface of the panel P. The grindstone 23 is supported by the spring-type pressure cylinder 24. When the panel P, along with the moving table 13, further moves in the direction of arrow E under the grindstone 23, therefore, the grindstone 23 shifts its position vertically along the curved surface of the panel P.

Figure 6:
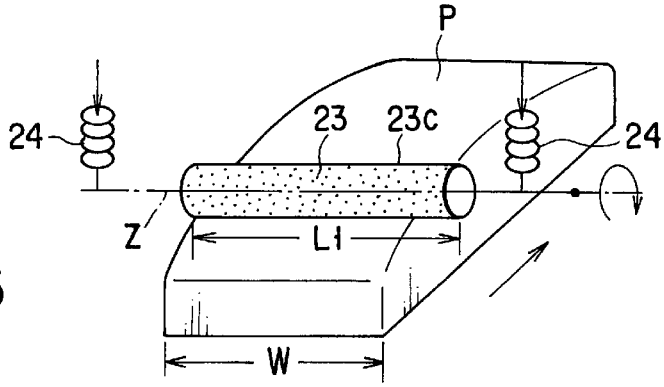
FIG. 6 is a perspective view conceptually showing the basic configuration of the glass product machining apparatus according to the first embodiment of the invention.
Figure 7:
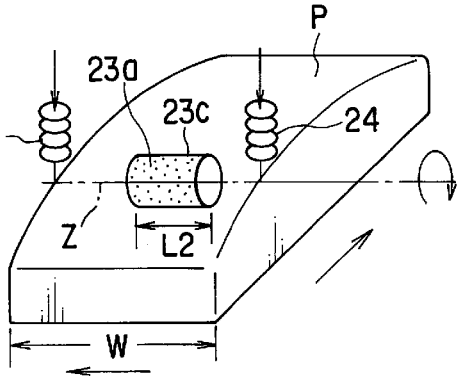
FIG. 7 is a perspective view conceptually showing the basic configuration of the glass product machining apparatus shown in FIG. 6 that uses a shorter grindstone.

As this is done, the outer peripheral surface 23*c* of the grindstone 23 is brought into contact with the surface of the panel P with a fixed force of pressure by the elastic load applied by the pressure cylinder 24. Thus, as the panel P passes under the grindstone 23, its surface is ground by the grindstone 23. FIG. 6 shows the basic concept of this grinding method.

The extent of grinding of the panel P is settled in consideration of the correlation between the type of the grindstone 23, grinding pressure, depth of cut, ground surface roughness, etc. More specifically, the difference between the external dimension of the unmachined panel P and a predetermined final dimension of the panel P to be machined is obtained by measuring the external dimension of the panel P after press molding, and the necessary depth of cut for grinding is determined. Further, the force (contact pressure) of the grindstone 23 to press the panel P, the moving speed of the panel P, the rotational speed of the grindstone 23, etc. are settled corresponding to the necessary extent of grinding. In particular, the force of pressure of the grindstone 23 is variably set by adjusting the fluid pressure of the pressure cylinder 24.

Under the grinding conditions settled in this manner, the panel P is passed once under the rotating grindstone 23. By doing this, the surface of the panel P is shaped and finished having a predetermined dimension by one cycle of grinding by means of the grindstone 23. Thus, according to the machining apparatus A, the machining time can be made much shorter than in the case of the conventional polishing system. Moreover, a polishing slurry, which is essential to the conventional polishing system, is unnecessary, so that the cost of equipment, environmental conditions, etc. can be improved considerably.

In some cases, the surface of the panel P may be inclined at an angle θ to a horizontal segment G, thus causing a difference in height between the opposite end portions of the panel P, as indicated by two-dot chain line B in FIG. 5. In the machining apparatus A according to the present embodiment, the main spindle 22 of the grindstone 23 is supported on the supporting arm 19 by means of the elastic bodies 25. As the elastic bodies 25 are elastically deformed, the outer peripheral surface 23*c* of the grindstone 23 can shift its position along the inclined surface of the panel P. Thus, the grindstone 23, having its axis Z in the width direction of the panel P, can touch the panel P across its width. Even if the panel P is inclined, therefore, its whole surface can be ground uniformly.

With the passage of working time, the working surface of the grindstone 23 is loaded, so that the grinding capability of the grindstone 23 is lowered. If the grinding capability of the grindstone 23 is lowered during use, the dressing machine 33 is actuated. When the machine 33 is actuated, the dresser 39 is rotated by the motor 37, and the moving table 13 is moved in the direction indicated by arrow E in FIG. 2 by the motor 12. Thereupon, the holder 35 moves integrally with the table 13 toward the grindstone 23, so that the dresser 39 comes into contact with the outer peripheral surface 23*c* of the grindstone 23. As the holder 35 in this state is further moved in the direction indicated by arrow Y in FIG. 3 along the guide rails 34 by the drive mechanism 36, the outer peripheral surface 23*c* of the grindstone 23 is dressed by the dresser 39. In truing the grindstone 23, the moving table 13 and the holder 35 are moved in the direction X (shown in FIG. 3) and the direction Y (direction along the axis Z of the grindstone 23), respectively, by actuating the motor 12 and the drive mechanism 36.

Thus, the grindstone 23 is dressed and trued with the dresser 39 held directly against it during use. Accordingly, loading of the grindstone 23 can be corrected easily and quickly to ensure reuse of the grindstone 23 without removing the grindstone 23 from the main spindle 22.

In the embodiment described above, the length (L1) of the grindstone 23 in the direction of the axis Z is made equal to or greater than the width (W) between the opposite ends of panel P. Accordingly, the whole surface of the panel P can be ground at a stroke when the panel P passes once under the grindstone 23. As in the case of a grindstone 23*a* shown in FIG. 7, however, the length (L2) of the grindstone in the direction of its axis z may be made shorter than the width W of the panel P to facilitate the manufacture of the grindstone. In this case, the position of the grindstone 23*a* is shifted in the width direction of the panel P every time the panel P passes under the grindstone 23*a* as the whole surface of the panel P is ground.

In the embodiment described above, the pressure cylinder 24 is used as the elastic load applying means for applying a fixed elastic load to the grindstone 23 (or 23*a*) that shifts its position upward. However, a spring member may be used in place of the cylinder 24.

Figure 8:
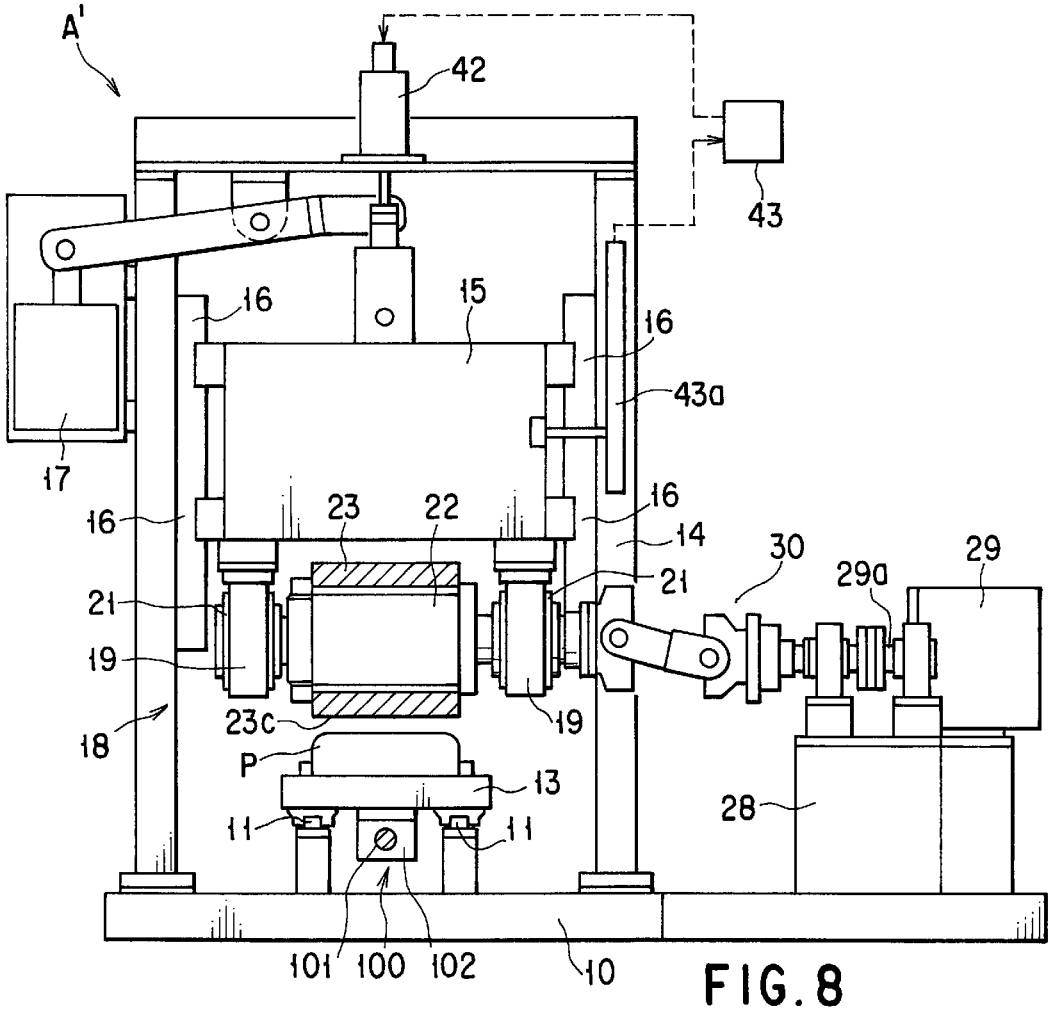
FIG. 8 is a front view, partially in section, showing a glass product machining apparatus according to a second embodiment of the invention.
Figure 9:
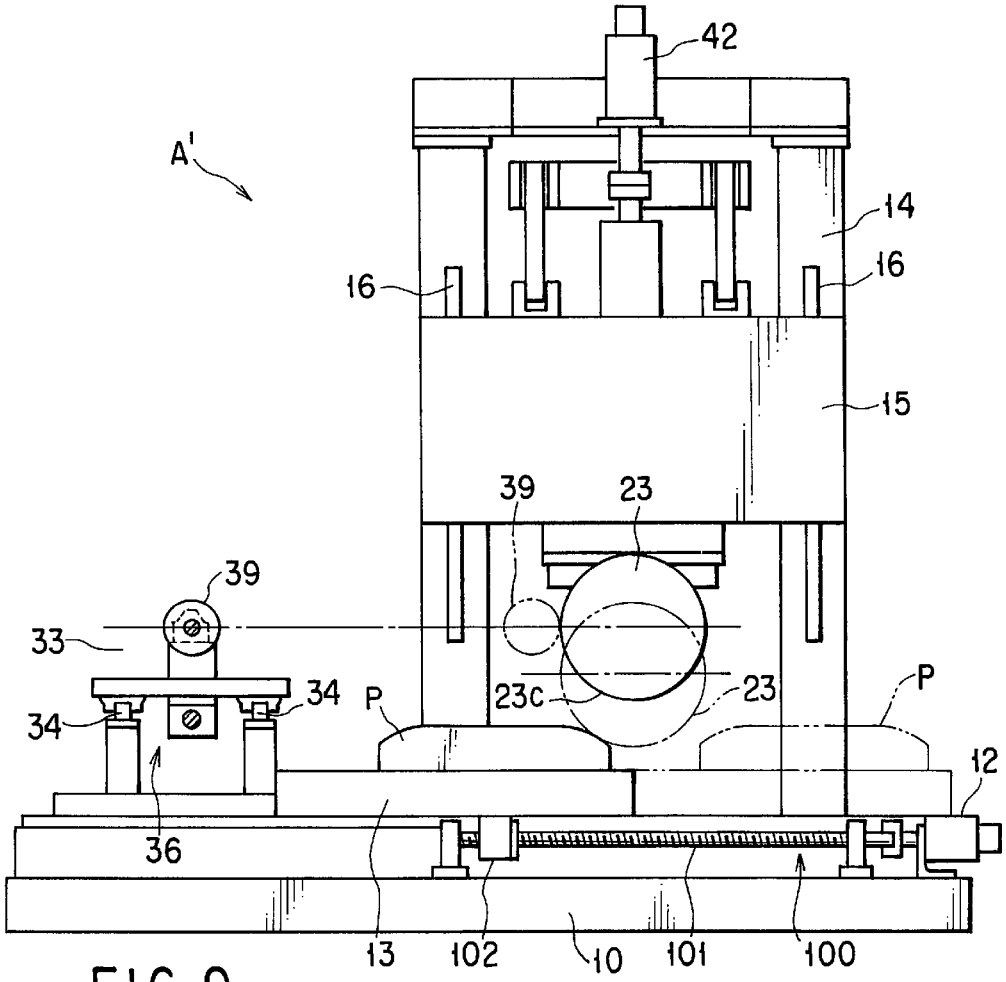
FIG. 9 is a side view of the glass product machining apparatus shown in FIG. 8.
Figure 10:
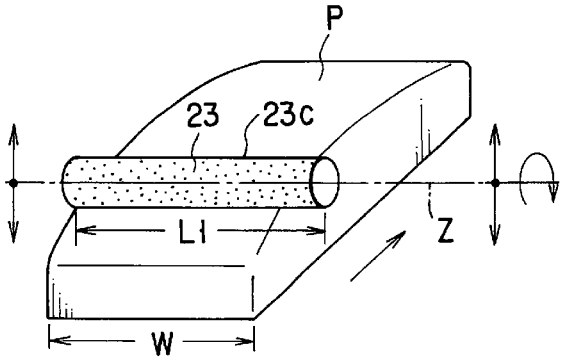
FIG. 10 is a perspective view conceptually showing the basic configuration of the glass product machining apparatus shown in FIG. 8.
Figure 11:
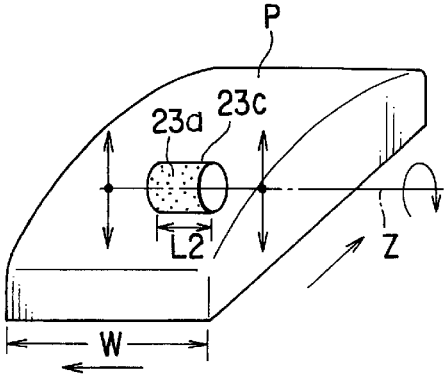
FIG. 11 is a perspective view conceptually showing the basic configuration of the glass product machining apparatus shown in FIG. 8 that uses a shorter grindstone.

FIGS. 8 to 10 show a machining apparatus A' according to a second embodiment of the invention. In the machining apparatus A of to the first embodiment, the grindstone 23 is relatively moved along the curved surface of the panel P to grind it in a manner such that the grindstone 23 is kept in contact with the panel surface under a fixed pressure by the elastic load applying means (pressure cylinder 24). On the other hand, the machining apparatus A' of the second embodiment shown in FIGS. 8 to 10 is designed to grind the surface of the panel P with the vertical position of the grindstone 23 controlled.

Thus, in the machining apparatus A' according to the second embodiment, a lift motor 42 for vertically shifting the position of the grindstone 23, a sensor 43*a*, such as an encoder, for detecting the vertical position of the lift 15, and a position control device 43 for controlling the motor 42 to adjust the position of the grindstone 23 are used in place of the pressure cylinder 24 according to the first embodiment.

The lift motor 42 and the position control device 43 constitute position control means according to the invention. A signal from the position sensor 43*a* is applied to the input of the position control device 43, which is formed of a microcomputer or the like. For other parts, the machining apparatus A' is constructed in the same manner as the apparatus A according to the first embodiment.

According to the second embodiment, the panel P is first fixed on the moving table 13 with its surface upward. The grindstone 23 is rotated by means of the motor 29, and the moving table 13 is actuated by means of the motor 12, whereupon the panel P is moved toward the grindstone 23.

When the panel P passes under the grindstone 23, the lift motor 42 is actuated by means of the position control device 43. The vertical position of the grindstone 23 is controlled by means of the motor 42 as the outer peripheral surface 23*c* of the grindstone 23 is brought into contact with the surface of the panel P to grind the panel P. FIG. 10 shows the basic concept of this grinding method.

The extent of grinding of the panel P is settled in consideration of the correlation between the type of the grindstone 23, grinding pressure, depth of cut, ground surface roughness, etc. More specifically, the external dimension of the panel P is measured after press molding. The difference between the measured value and a predetermined external dimension (final dimension of the panel P to be machined) is obtained, and the necessary depth of cut for grinding is determined. Further, the vertical position of the grindstone 23, the moving speed of the panel P, the rotational speed of the grindstone 23, etc. are settled corresponding to the necessary extent of grinding.

Under the grinding conditions settled in this manner, the panel P is passed once under the rotating grindstone 23. By doing this, the surface of the panel P is shaped and finished having a predetermined dimension by one cycle of grinding. Thus, according to the machining apparatus A', the machining time can be made much shorter than in the case of the conventional polishing system. Moreover, the polishing slurry, which is essential to the conventional polishing system, is unnecessary, so that the cost of equipment, environmental conditions, etc. can be improved considerably.

If the grinding capability of the grindstone 23 is lowered during the grinding operation by means of the grindstone 23, the dressing machine 33 is actuated. When the machine 33 is actuated, the dresser 39 is rotated by the motor 37. Further, the moving table 13 is moved by the motor 12, and the holder 35, along with the table 13, moves toward the grindstone 23, so that the dresser 39 comes into contact with the outer peripheral surface 23*c* of the grindstone 23. As the holder 35 in this state is further moved along the guide rails 34 by the drive mechanism 36, the outer peripheral surface 23*c* of the grindstone 23 is dressed by the dresser 39. In truing the grindstone 23, the moving table 13 and the holder 35 are moved in the directions X and Y, respectively (as in the case of the embodiment of FIG. 3), by actuating the motor 12 and the drive mechanism 36.

Thus, the grindstone 23 is dressed and trued with the dresser 39 held directly against it during use, so that loading of the grindstone 23 can be corrected easily and quickly to ensure reuse of the grindstone 23 without removing the grindstone 23 from the main spindle 22.

In the embodiment described above, the length (L1) of the grindstone 23 in the direction of the axis Z is made equal to or greater than the width (W) between the opposite ends of panel P. Accordingly, the whole surface of the panel P can be ground at a stroke when the panel P passes once under the grindstone 23. As in the case of a grindstone 23*a* shown in FIG. 11, however, the length (L2) of the grindstone 23*a* in the direction of its axis Z may be made shorter than the width W of the panel P to facilitate the manufacture of the grindstone. In this case, the position of the grindstone 23*a* is shifted in the width direction of the panel P every time the panel P passes under the grindstone 23*a* as the whole surface of the panel P is ground.

Figure 12:
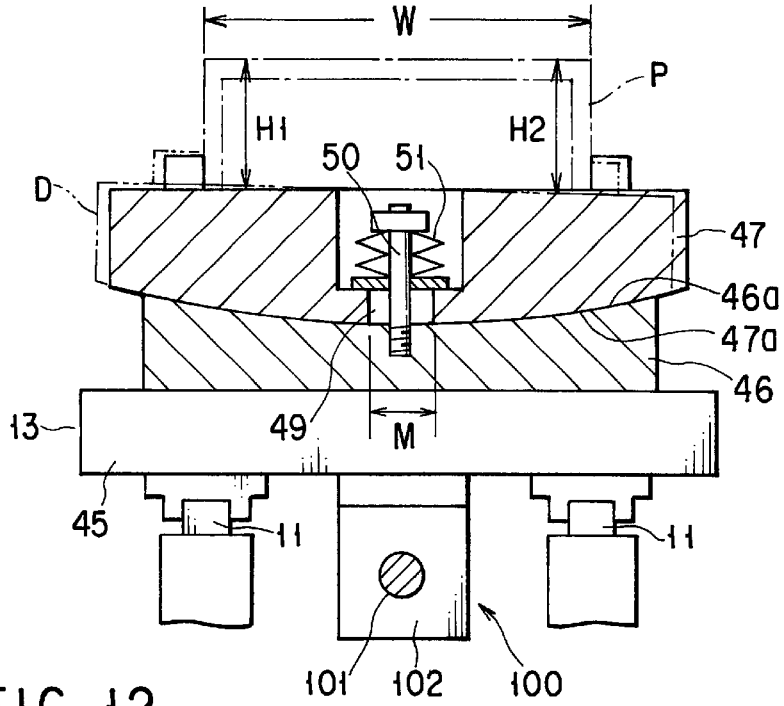
FIG. 12 is a sectional view showing an example of inclination adjusting means for correcting a crosswise inclination, if any, of the surface of the glass product.
Figure 13:
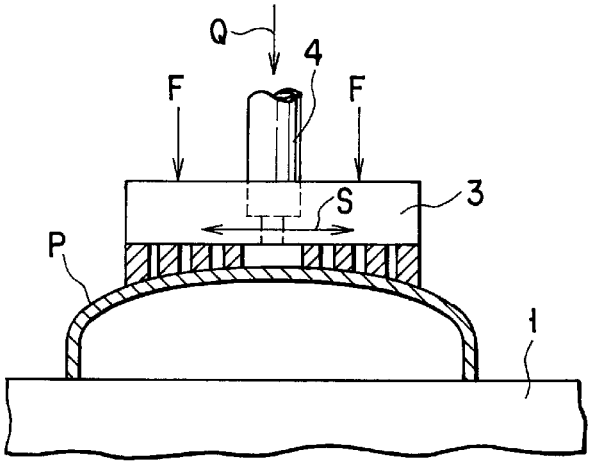
PRIOR ART FIG. 13
FIG. 13 is a side sectional view of a conventional polishing machine.
Figure 14:
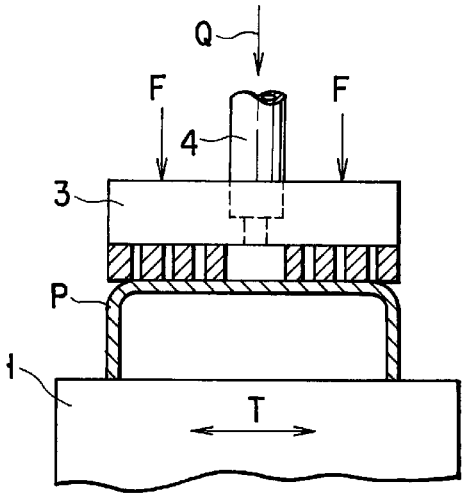
PRIOR ART FIG. 14
FIG. 14 is a front sectional view of the polishing machine shown in FIG. 13.

FIG. 12 shows an embodiment in which the moving table 13 is provided with inclination adjusting means as a measure to counter the inclination of the surface of the panel P in the width direction. The moving table 13 of this embodiment has a stationary plate 46 on a table body 45 that moves along the guide rails 11. Formed on the top surface of the plate 46 is a curved recess 46*a*, which has a profile in the form of a circular arc extending in the longitudinal direction of the plate 46 (direction along the width W of the panel P). A movable plate 47 is located on the stationary plate 46. Formed on the undersurface of the movable plate 47 is a curved protuberance 47*a*, which has a profile in the form of a circular arc corresponding to the recess 46*a*. The protuberance 47*a* is fitted in the recess 46*a* of the stationary plate 46 so as to be slidable along the curved surface of the recess 46*a*.

A hole 49 is bored through the central portion of the movable plate 47. A stud bolt 50 is attached to the stationary plate 46. The bolt 50 is inserted into the hole 49 from above the movable plate 47. The outside diameter of the bolt 50 is smaller than the inside diameter (M) of the hole 49. A coned disk spring 51 for use as an elastic member is provided on the upper part of the bolt 50. As the movable plate 47 is pressed against the stationary plate 46 by means of the elastic force of the spring 51, a moderate contact pressure is produced between the curved protuberance 47*a* and the curved recess 46*a*.

The panel P is placed on the movable plate 47. The moving table 13 moves in this state. As the panel P is fed under the grindstone 23, its surface is ground by the outer peripheral surface 23*c* of the grindstone 23. Let it now be supposed that there is a difference between the respective heights (H1 and H2) of the opposite side portions of the panel P and that the surface of the panel P is inclined in its width direction. When the surface of the panel P touches the outer peripheral surface 23*c* of the grindstone 23, in this case, the curved protuberance 47*a* of the movable plate 47 slides along the curved recess 46*a* of the stationary plate 46, whereupon the movable plate 47 tilts sideways. As this is done, the difference in height between the opposite side portions of the panel P is absorbed, so that the extent of grinding by means of the grindstone 23 can be kept uniform throughout the surface of the panel P.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A glass product machining apparatus for grinding a surface of a glass product, comprising:

a base frame having vertical guide members;

a grindstone rotatable around an axis and having an outer peripheral surface;

supporting means for supporting the grindstone for vertical movement and rotation around the axis;

grindstone driving means for rotating the grindstone around the axis;

a moving table located below the grindstone, movable in the cross direction of the grindstone, and fixing the glass product with the surface upward;

vertically moving means for moving the grindstone supported by the supporting means, upward and downward with respect to a desired extent of grinding of the glass product, while the glass product, along with the moving table, moves under the grindstone;

a feed mechanism for moving the moving table horizontally with respect to the grindstone in the cross direction thereof, while said outer peripheral surface of the grindstone is in contact with the glass product, thereby relatively moving the grindstone along the surface of the glass product; and a counterweight mechanism for urging said grindstone and said supporting means upward, the counterweight mechanism having a balance link including a first end and a second end and supported on an upper portion of the frame by means of a pivot pin which is situated between both said ends, a counterweight balancing with weight of said grindstone and said supporting means, a first pivot mechanism that connects said first end of the balance link to said supporting means, and a second pivot mechanism that connects said second end of the balance link to said counterweight.

2. A glass product machining apparatus according to claim 1, wherein said vertically moving means is an elastic load applying means which applies an elastic load to the grindstone supported by the supporting means as the position of the grindstone is shifted upward, thereby bringing the outer peripheral surface of the grindstone into contact with the surface of the glass product with a predetermined force of pressure, while the glass product, along with the moving table, moves under the grindstone.

3. A glass product machining apparatus according to claim 1, wherein said vertically moving means is position control means which controls the vertical position of the grindstone supported by the supporting means so that the outer peripheral surface of the grindstone cuts to a predetermined depth into the surface of the glass product while the glass product, along with the moving table, moves under the grindstone.

4. A glass product machining apparatus according to claim 2, wherein a distance between the second pivot mechanism and the pivot pin is greater than a distance between the first pivot mechanism and the pivot pin.

5. A glass product machining apparatus according to claim 2, further comprising a dressing machine for dressing or truing the grindstone, the dressing machine including a holder movable integrally with the moving table in the cross direction of the grindstone, a dresser on the holder, a motor on the holder for rotating the dresser, and a drive mechanism for moving the holder in the direction of an axis of the grindstone.

6. A glass product machining apparatus according to claim 3, further comprising a dressing machine for dressing or truing the grindstone, the dressing machine including a holder movable integrally with the moving table in the cross direction of the grindstone, a dresser on the holder, a motor on the holder for rotating the dresser, and a drive mechanism for moving the holder in the direction of an axis of the grindstone.

7. A glass product machining apparatus according to claim 2, further comprising inclination adjusting means for correspondingly inclining the grindstone or the glass product when the surface of the glass product on the moving table is inclined at an angle to the axis of the grindstone in the width direction of the glass product, thereby automatically adjusting the inclination of the grindstone or the glass product so that the glass product and the grindstone are uniformly in contact with each other with respect to the direction of the axis.

8. A glass product machining apparatus according to claim 3, further comprising inclination adjusting means for correspondingly inclining the grindstone or the glass product when the surface of the glass product on the moving table is inclined at an angle to the axis of the grindstone in the width direction of the glass product, thereby automatically adjusting the inclination of the grindstone or the glass product so that the glass product and the grindstone are uniformly in contact with each other with respect to the direction of the axis.

9. A glass product machining apparatus according to claim 2, wherein the length of said grindstone in the direction of the axis is equal to or greater than the width of the glass product, so that the whole surface of the glass product can be ground at a stroke by the grindstone when the glass product passes once under the grindstone.

10. A glass product machining apparatus according to claim 3, wherein the length of said grindstone in the direction of the axis is equal to or greater than the width of the glass product, so that the whole surface of the glass product can be ground at a stroke by the grindstone when the glass product passes once under the grindstone.

11. A glass product machining apparatus according to claim 2, wherein the length of said grindstone in the direction of the axis is shorter than the width of the glass product, so that the grindstone is relatively moved in the width direction of the glass product with each of times the glass product is caused to pass under the grindstone as the whole surface of the glass product is ground.

12. A glass product machining apparatus according to claim 3, wherein the length of said grindstone in the direction of the axis is shorter than the width of the glass product, so that the grindstone is relatively moved in the width direction of the glass product with each of times the glass product is caused to pass under the grindstone as the whole surface of the glass product is ground.

* * * * *